US008016505B2

(12) United States Patent
Zekaj

(10) Patent No.: US 8,016,505 B2
(45) Date of Patent: Sep. 13, 2011

(54) LETTER OPENER

(76) Inventor: Kole Zekaj, West Bloomfield, MI (US)

( * ) Notice: Subject to any disclaimer, the term of this patent is extended or adjusted under 35 U.S.C. 154(b) by 746 days.

(21) Appl. No.: 12/102,078

(22) Filed: Apr. 14, 2008

(65) Prior Publication Data

US 2009/0257814 A1 Oct. 15, 2009

(51) Int. Cl.
*B43K 29/00* (2006.01)
*B43K 23/02* (2006.01)
*B26B 11/00* (2006.01)

(52) U.S. Cl. ..... 401/195; 401/131; 7/160

(58) Field of Classification Search ..... 401/131, 401/195, 52; 7/160, 158
See application file for complete search history.

(56) References Cited

U.S. PATENT DOCUMENTS

| | | | | |
|---|---|---|---|---|
| 4,081,907 | A | 4/1978 | Bosshold | |
| 6,065,169 | A | 5/2000 | Cheldin | |
| 6,163,910 | A | 12/2000 | Cheldin | |
| D450,086 | S | 11/2001 | Rosenbaum | |
| 6,846,123 | B1 * | 1/2005 | Bedford | 401/195 |
| 7,287,925 | B2 * | 10/2007 | Barker | 401/195 |

* cited by examiner

*Primary Examiner* — David J. Walczak
*Assistant Examiner* — Bradley Oliver
(74) *Attorney, Agent, or Firm* — Dale J. Ream

(57) ABSTRACT

A letter opening device for use with a writing instrument having a writing end and a distal end includes an elongate clip and a protrusion generally perpendicular from the elongate clip for operative coupling to the writing instrument. The letter opening device also includes a cutting blade extending between the elongate clip and the protrusion to open a letter when the letter is passed between the elongate clip and the writing instrument from the distal end toward said writing end. The protrusion may alternatively be coupled to a sleeve for removable attachment to the writing instrument.

12 Claims, 5 Drawing Sheets

LETTER OPENER

BACKGROUND OF THE INVENTION

This invention relates generally to letter openers and, more particularly, to a letter opener for use with or integrally attached to a pen or mechanical pencil. More particularly, the present letter opener provides quick access to a tool for opening envelopes while still enabling the pen to be used as a writing instrument.

Business professionals typically have the responsibility of opening large amounts of mail every day, including letters, bills, solicitations, and the like. A letter opener having a blade or serrated edge is frequently utilized to open the envelopes rather than manually tearing each one open with one's fingers. Another crucial tool to a business professional, of course, is a pen for use as a writing instrument. In fact, a pen is often needed to write notes on the mail or as a result of the mail, to write instructions to other employees, or if other matters cause an interruption to opening the mail. In other words, these two tools used by a business professional—a letter opener and a pen—are needful at substantially the same time and it is inconvenient to have to frequently switch between them.

Various devices have been proposed in the art for combining a letter opener with a writing instrument. Although assumably effective for their intended purposes, the existing devices do not provide a letter opener for attachment to a writing instrument for conveniently opening an envelope in a manner that maximizes safety and that enables simultaneous use of the writing implement.

Therefore, it would be desirable to have a letter opener that is integrally attached to or even removably attached to a writing instrument that may be conveniently used to open envelopes without inhibiting continued use of the writing implement. Further, it would be desirable to have a letter opener that may be used safely when being used as a letter opener and also when using the writing implement.

SUMMARY OF THE INVENTION

Accordingly, a letter opening device according to the present invention for use with a writing instrument having a writing end and a distal end includes an elongate clip and a protrusion generally perpendicular from the elongate clip for operative coupling to the writing instrument. The letter opening device also includes a cutting blade extending between the elongate clip and the protrusion to open a letter when the letter is passed between the elongate clip and the writing instrument from the distal end toward said writing end.

Further, the elongate clip includes a first portion extending from the protrusion toward the writing end and a second portion extending from the protrusion toward the distal end. The first portion is longer than the second portion and the cutting blade extends between the elongate clip second portion and the protrusion.

In one embodiment, the elongate clip is rotatable between first and second configurations. When at the second configuration, the elongate clip first portion extends toward the distal end to open a letter passing between the elongate clip and the writing instrument from the distal end toward the writing end. A stationary post extends adjacent the elongate clip to restrict access to the cutting blade when the elongate clip is at the first configuration.

Therefore, a general object of this invention is to provide a letter opening device for use with a writing instrument such that either instrument is readily available for use.

Another object of this invention is to provide a letter opening device, as aforesaid, that is safe to use in that the blade may be shielded from unintended contact with a user.

Still another object of this invention is to provide a letter opening device, as aforesaid, that in one embodiment is integrally coupled to a writing instrument.

Yet another object of this invention is to provide a letter opening device, as aforesaid, that may be removably coupled to a writing instrument.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A letter opener 100 according to the present invention will now be described in detail with reference to FIGS. 1*a* through 7 of the accompanying drawings. More particularly, according to the current invention, a letter opener 100 includes an elongate clip 110 and a cutting blade 120.

Figure 1A:
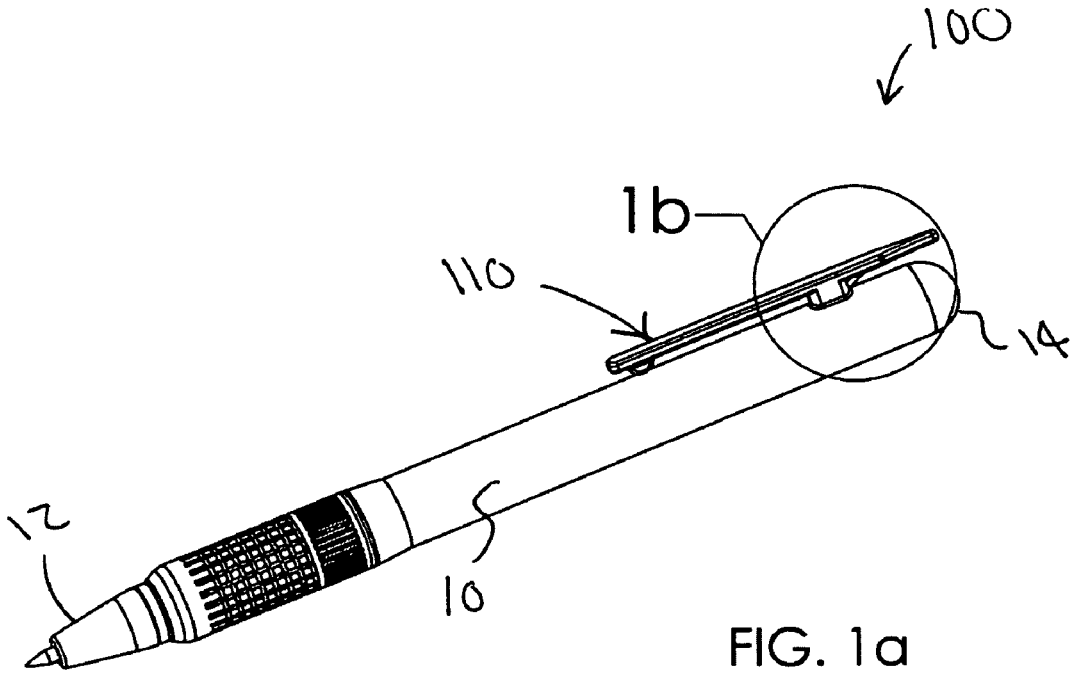
FIG. 1*a* is a perspective view of a letter opening device according to one embodiment of the present invention.
Figure 1B:
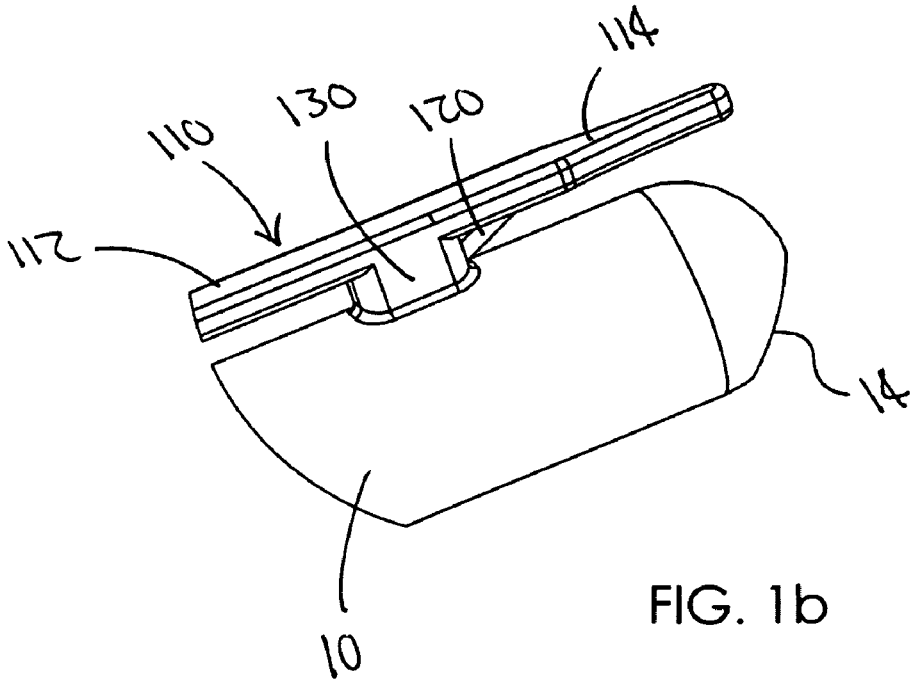
FIG. 1*b* is an isolated view on an enlarged scale taken from a portion of FIG. 1*a;*
Figure 2:
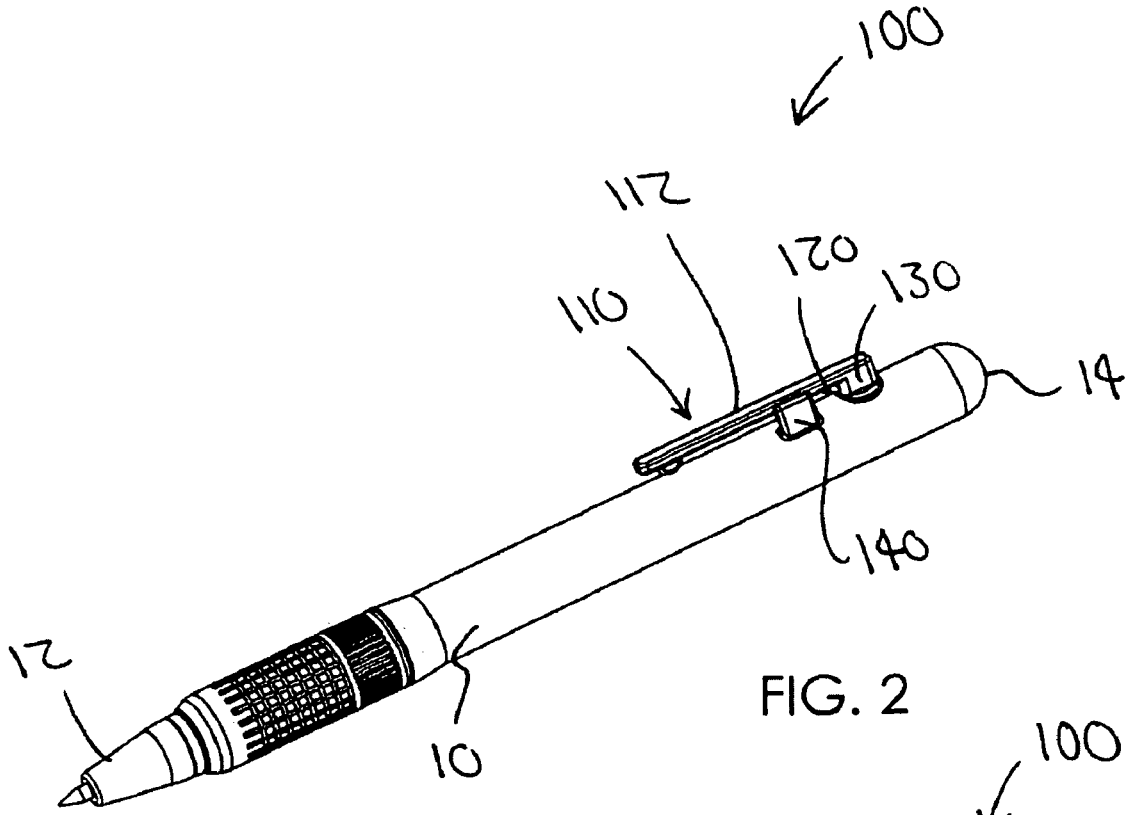
FIG. 2 is a perspective view of a letter opening device according to another embodiment of the present invention, shown with an elongate clip in a first configuration.
Figure 5:
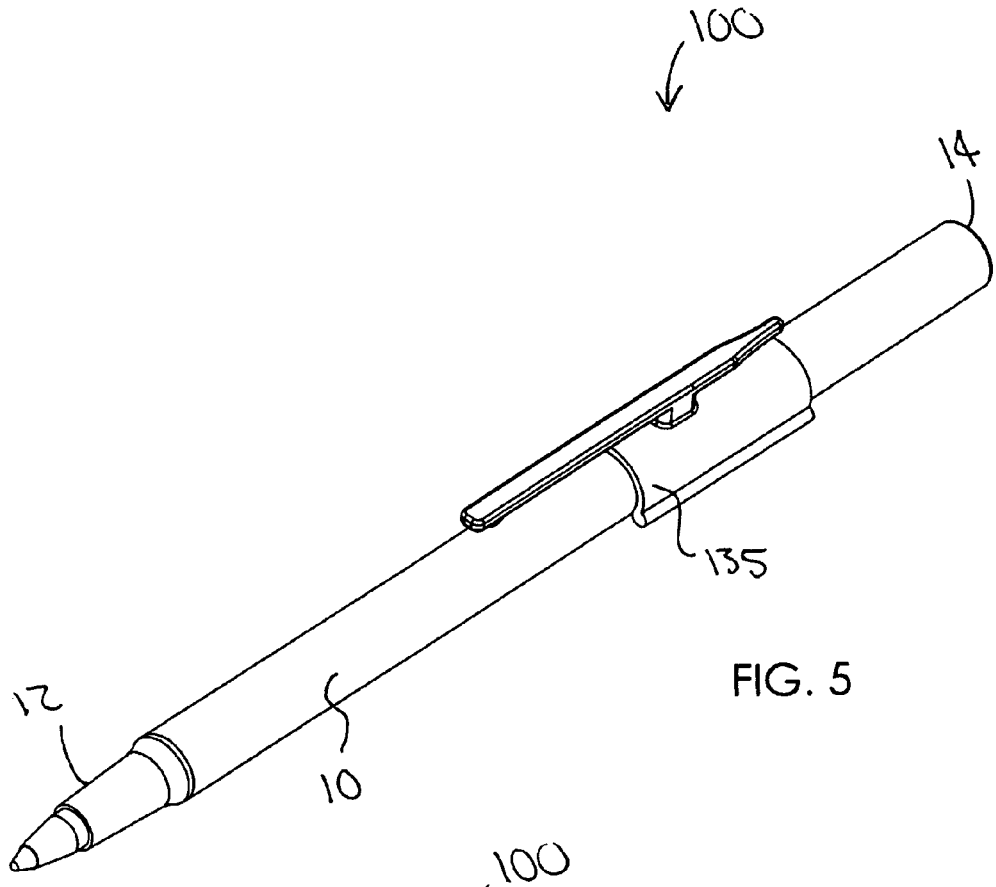
FIG. 5 is a perspective view of a letter opening device according to another embodiment of the present invention.
Figure 6:
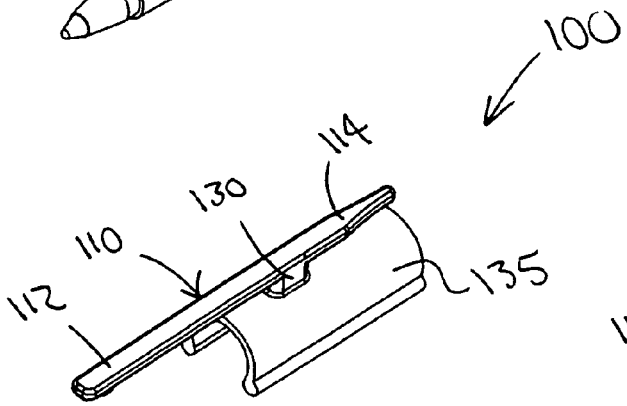
FIG. 6 is a perspective view of a sleeve and clip of the letter opening device as in FIG. 5 with the pen removed.
Figure 7:
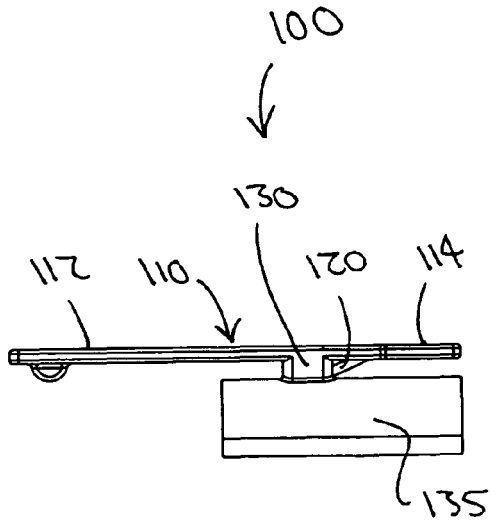
FIG. 7 is a side view of the sleeve and clip as in FIG. 6.
Figure 8:
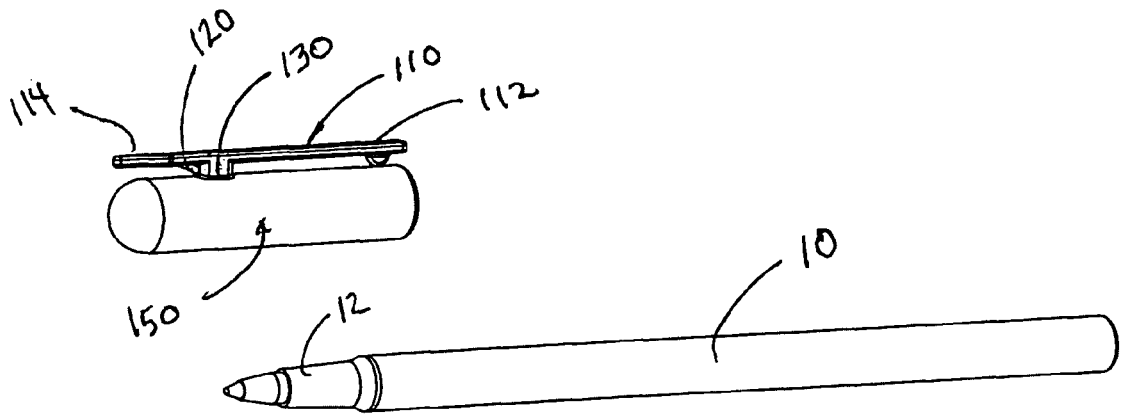
FIG. 8 is a perspective view of a letter opening device according to another embodiment of the present invention.
Figure 9:
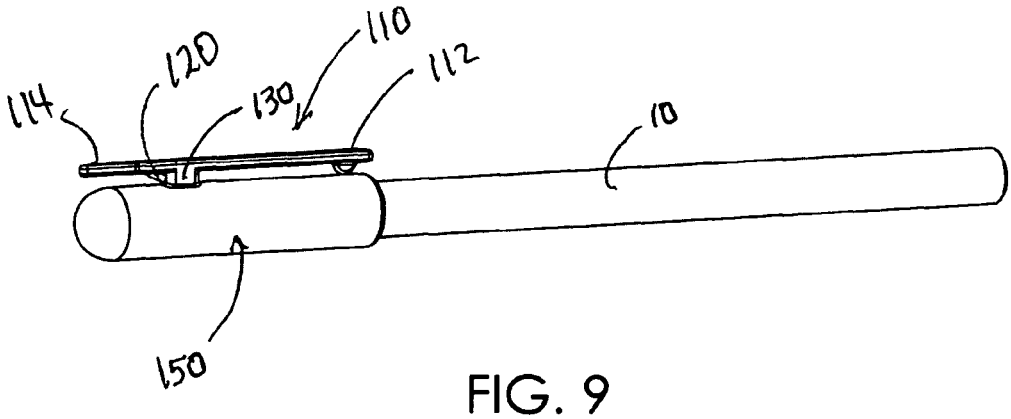
FIG. 9 is a perspective view of a letter opening device with the cap coupled to the writing instrument.
Figure 1A:
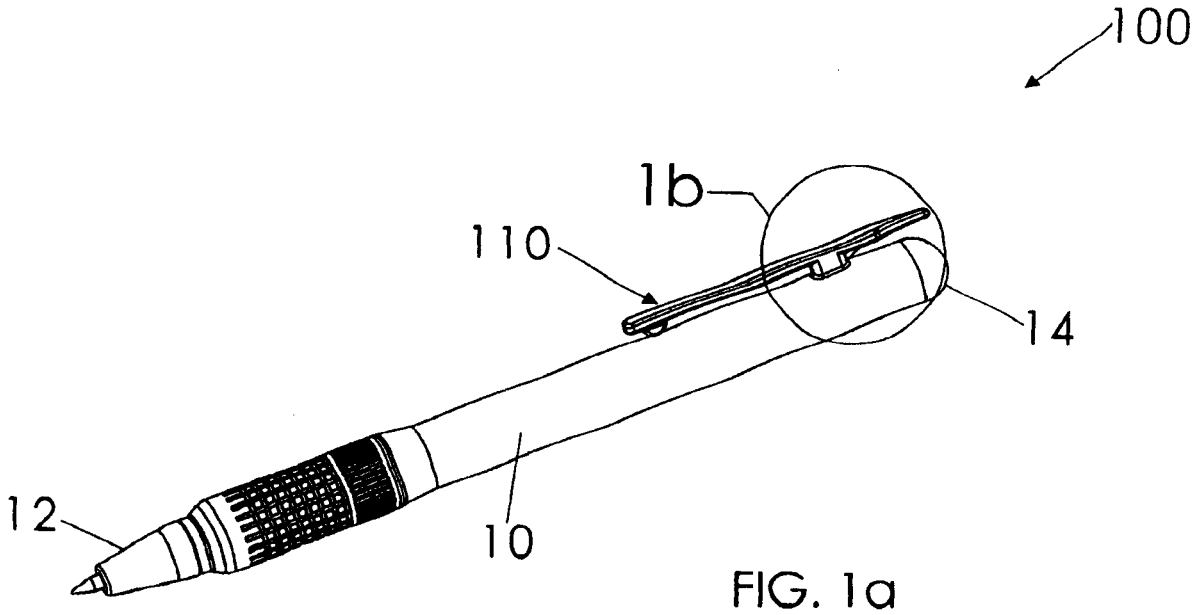
Figure 1B:
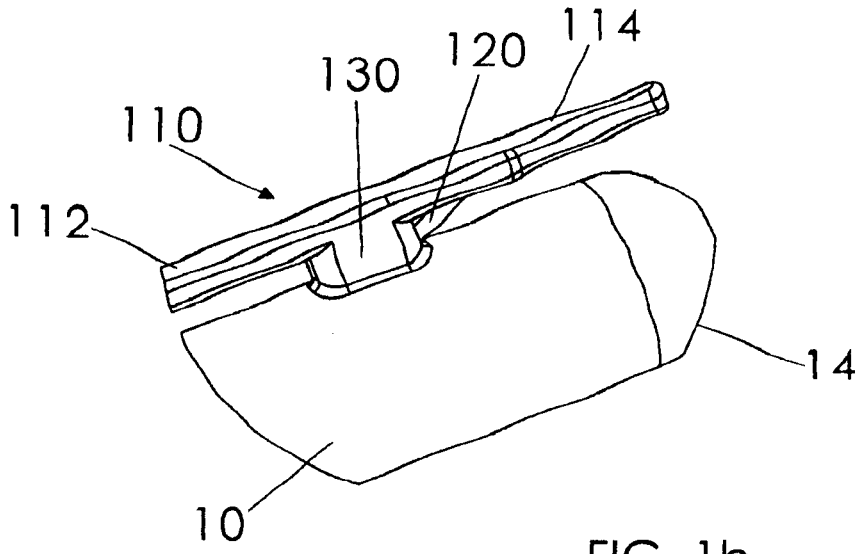
Figure 2:
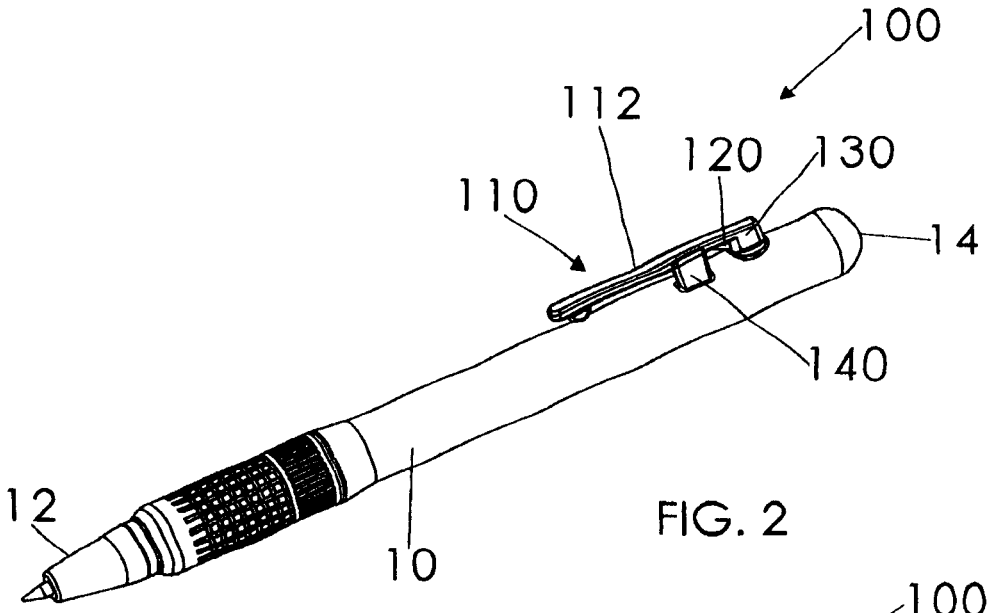
Figure 3:
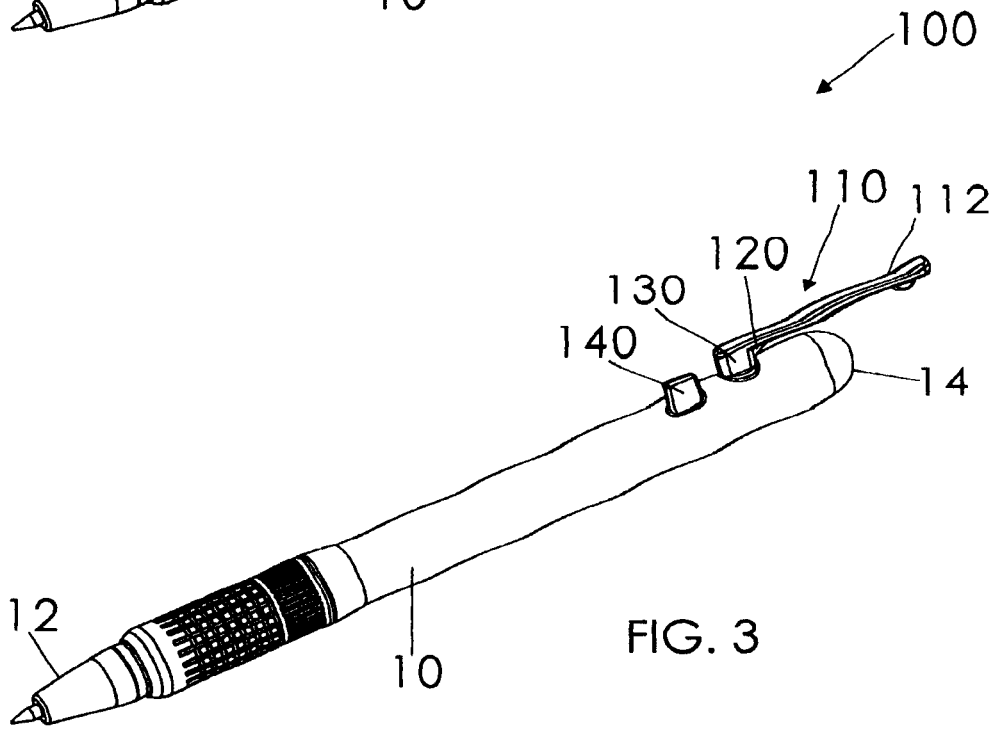
Figure 4A:
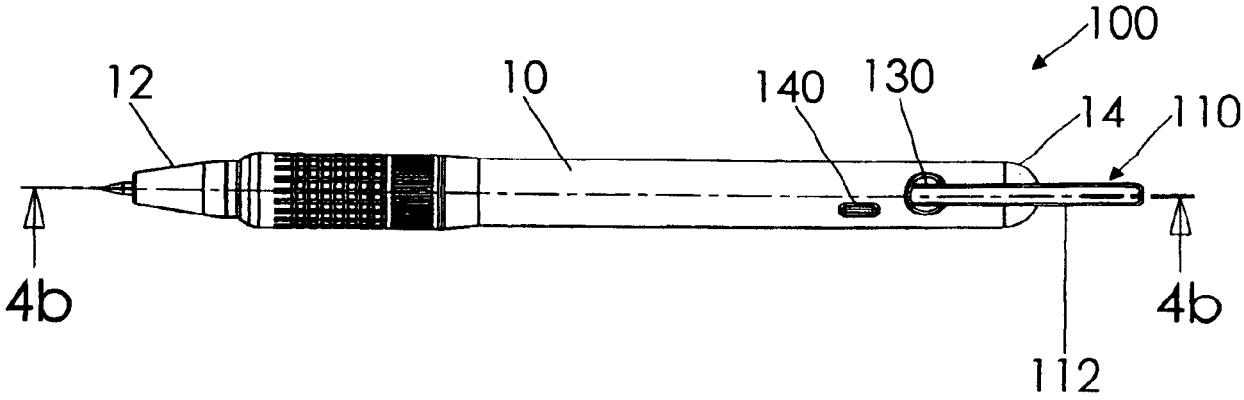
Figure 4B:
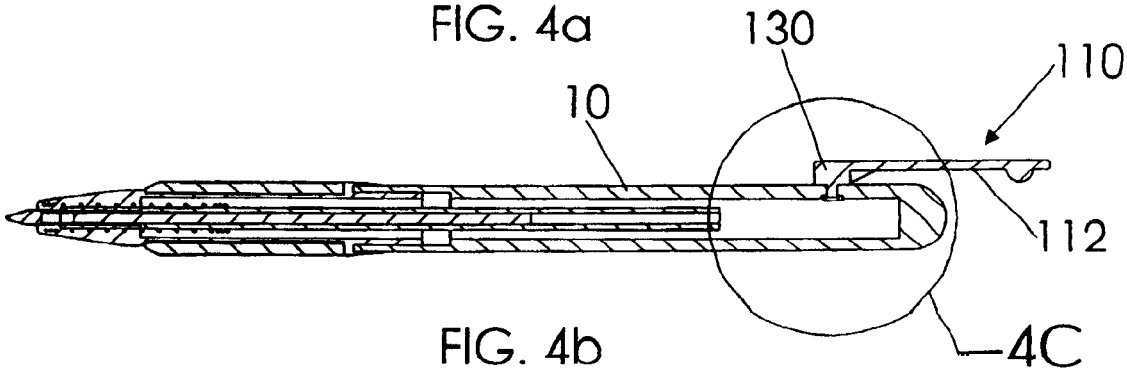
Figure 4C:
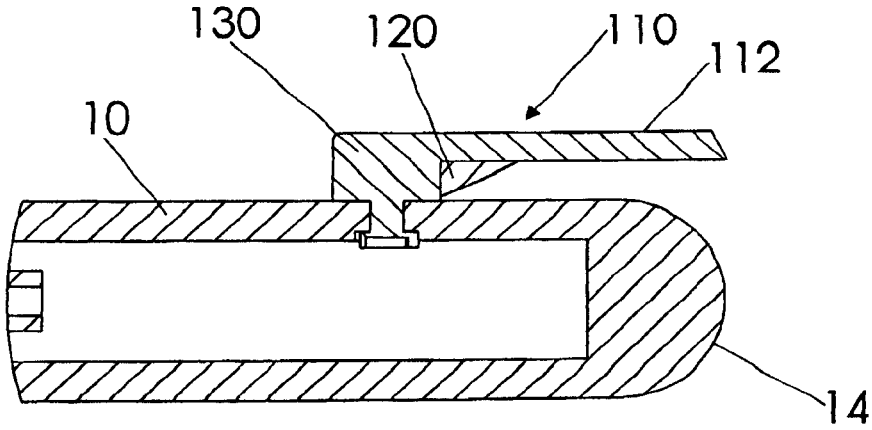
Figure 5:
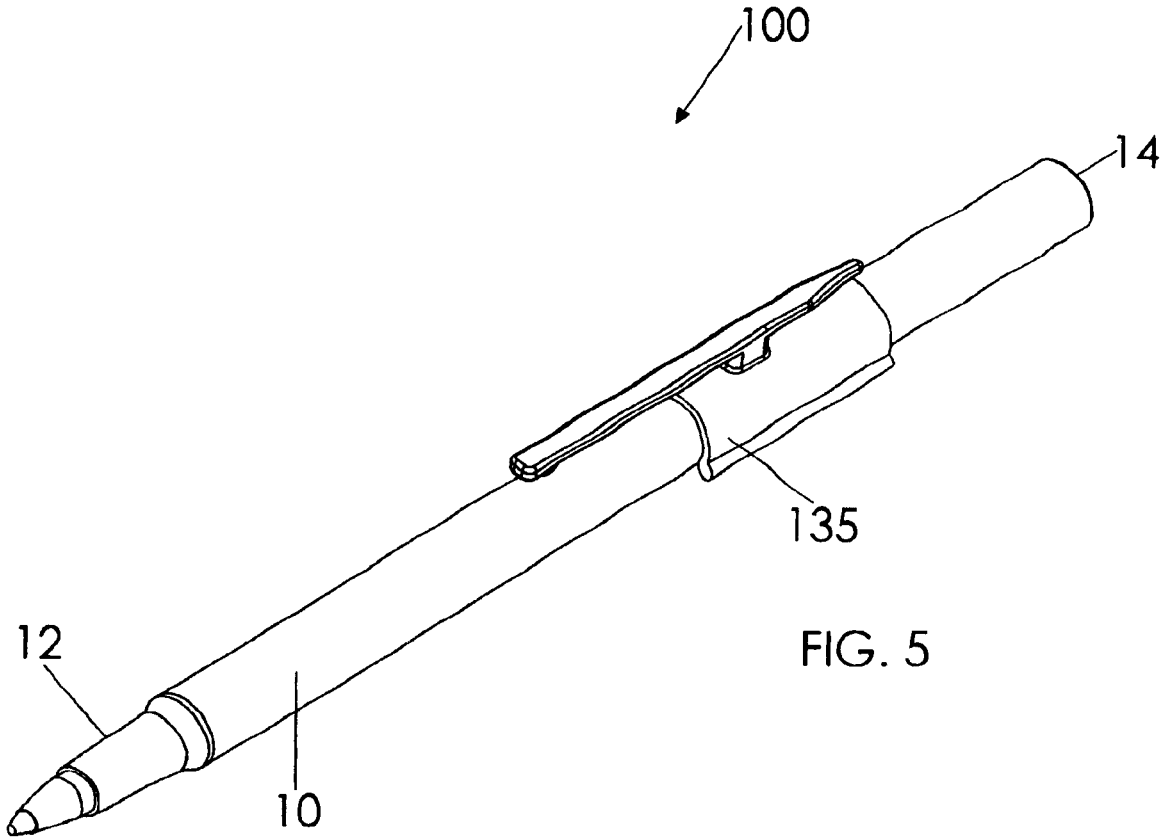
Figure 6:
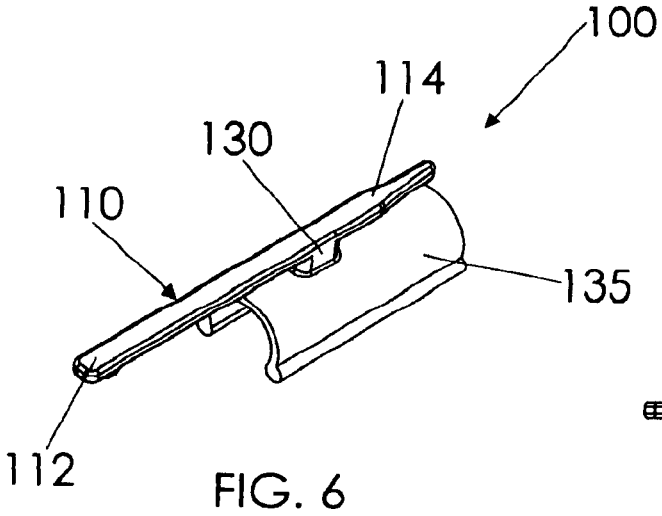
Figure 7:
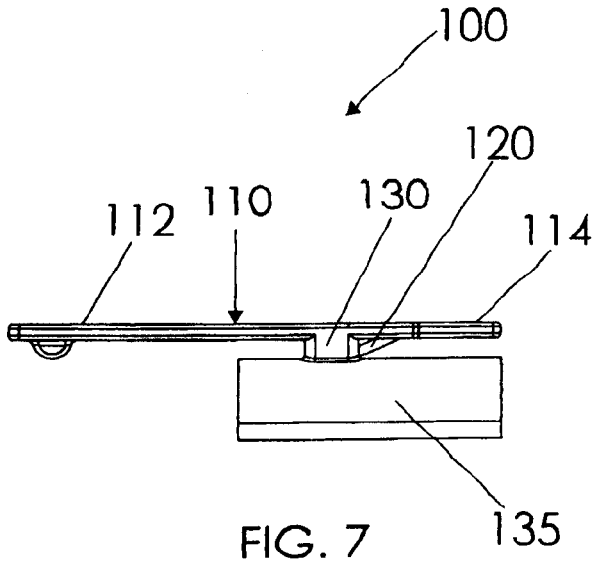
Figure 8:
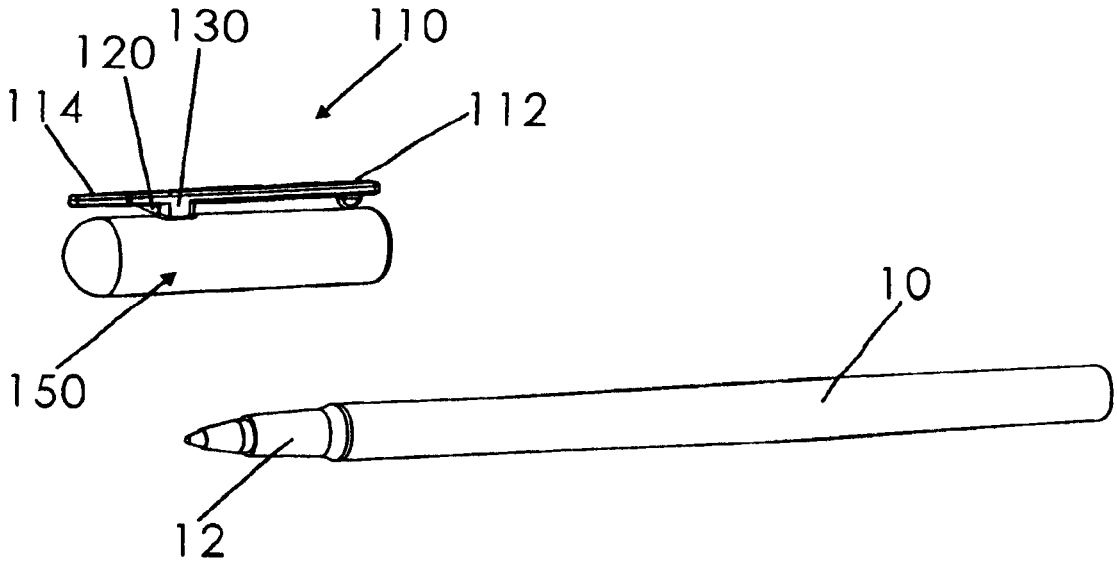
Figure 9:
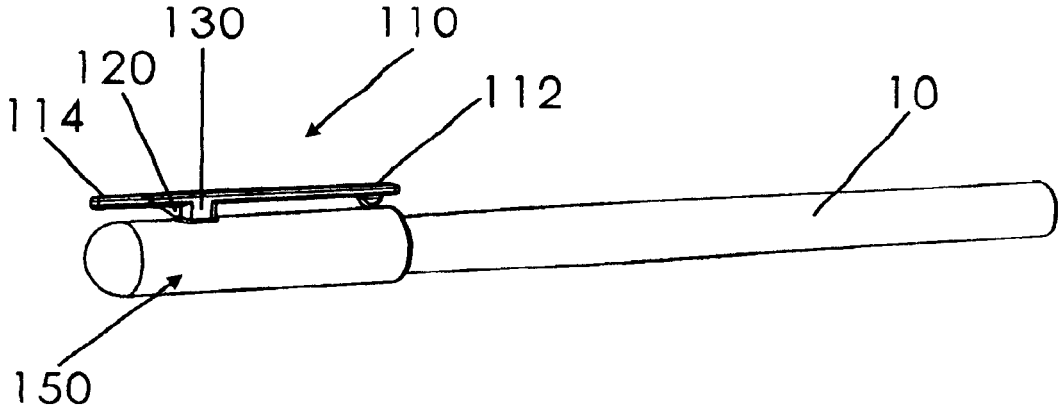
Figure 1A:
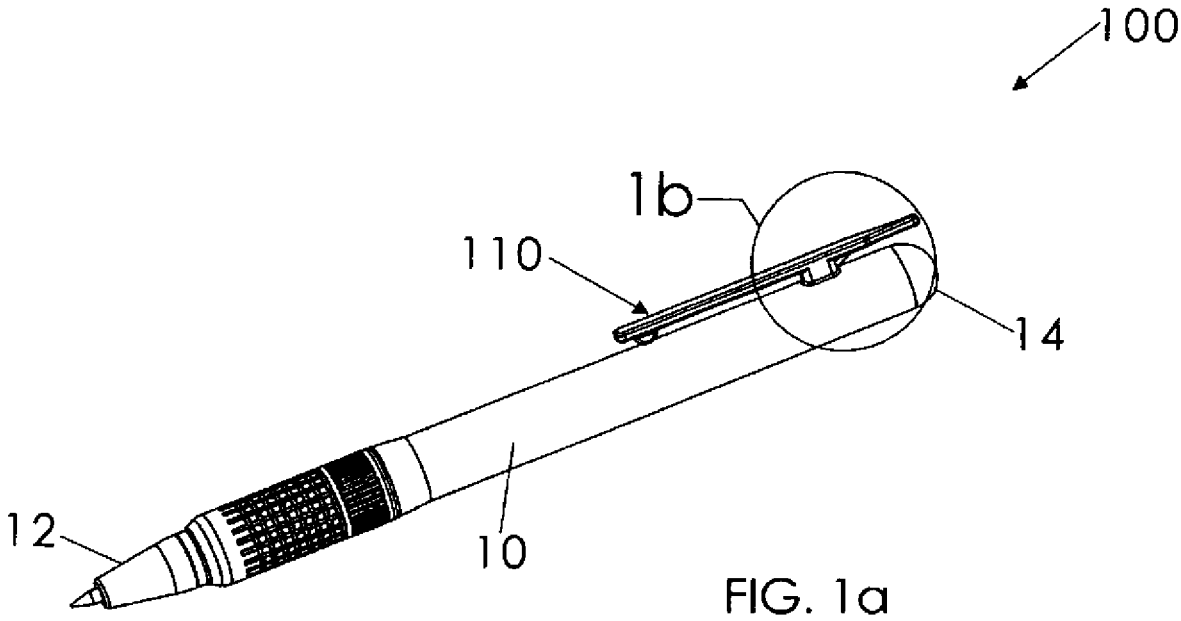
Figure 1B:
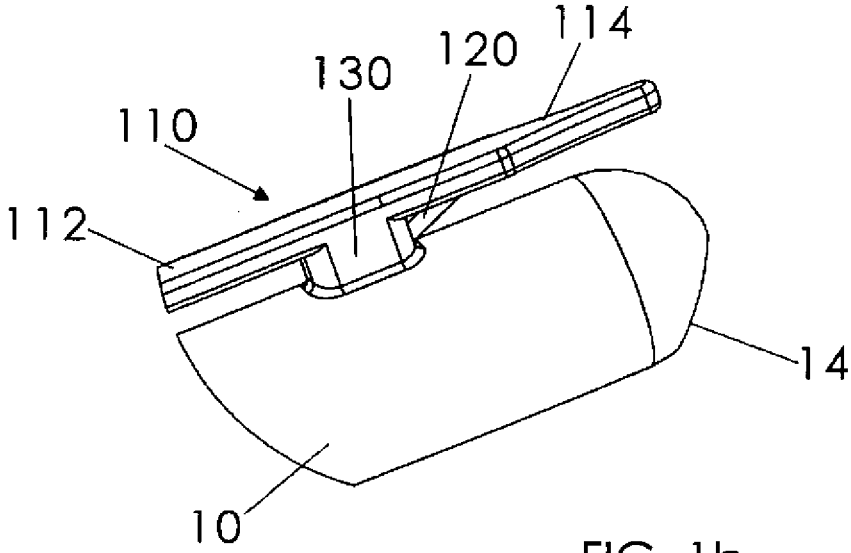
Figure 2:
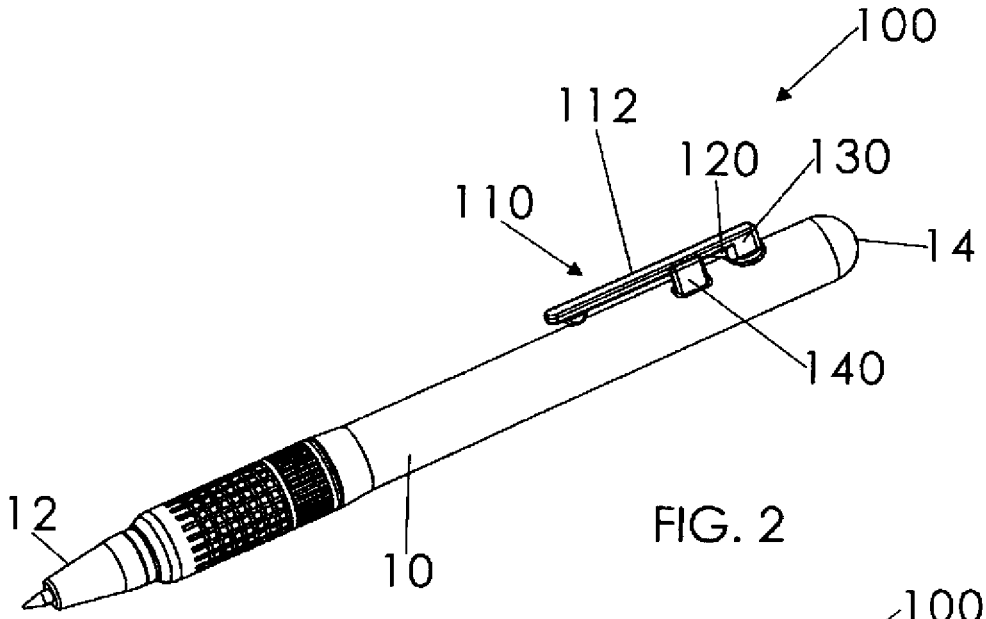
Figure 3:
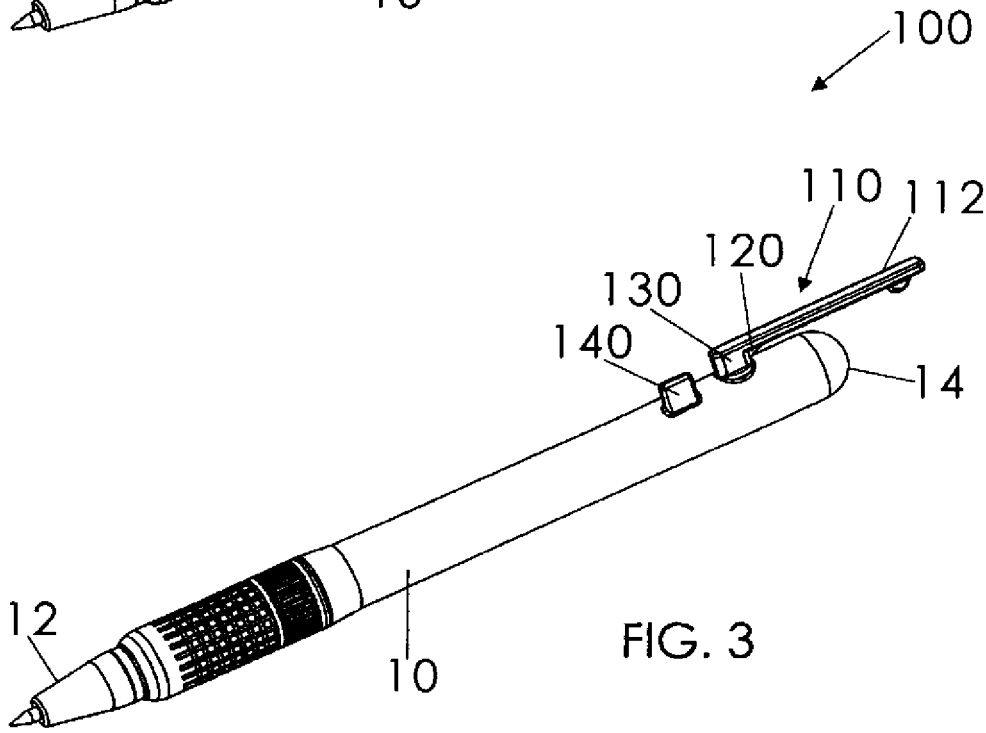
Figure 4A:
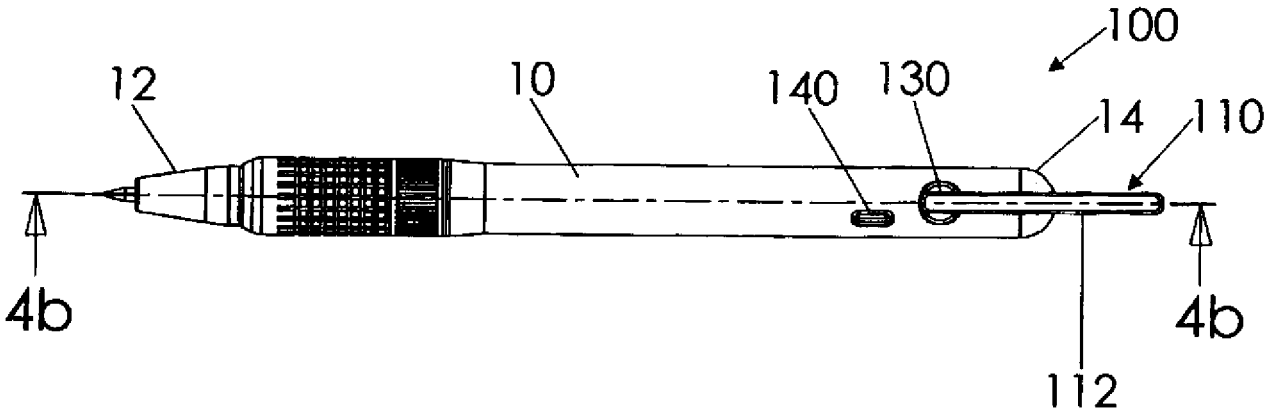
Figure 4B:
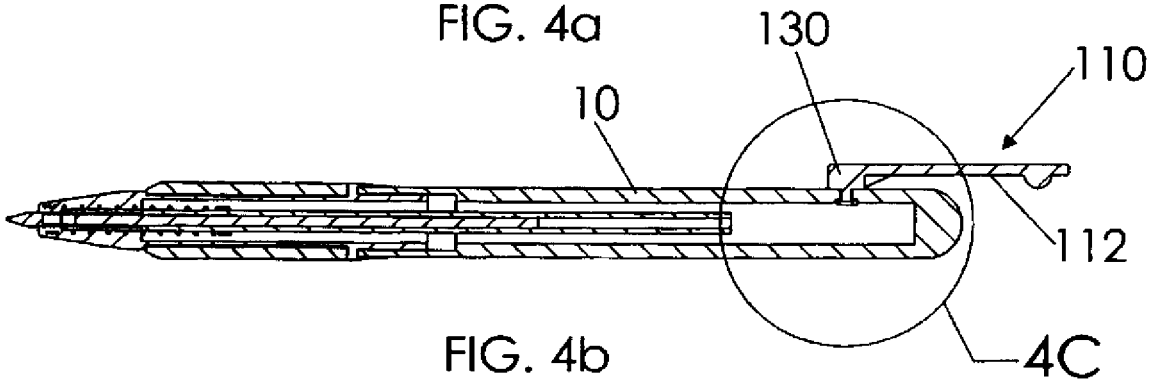
Figure 4C:
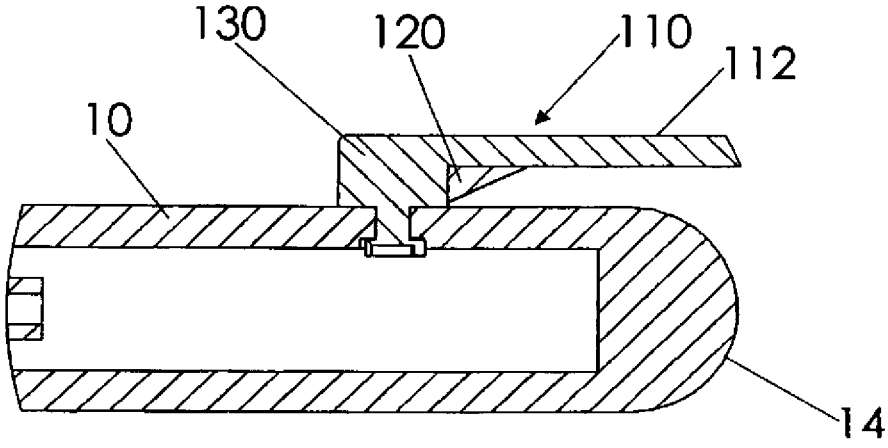
Figure 5:
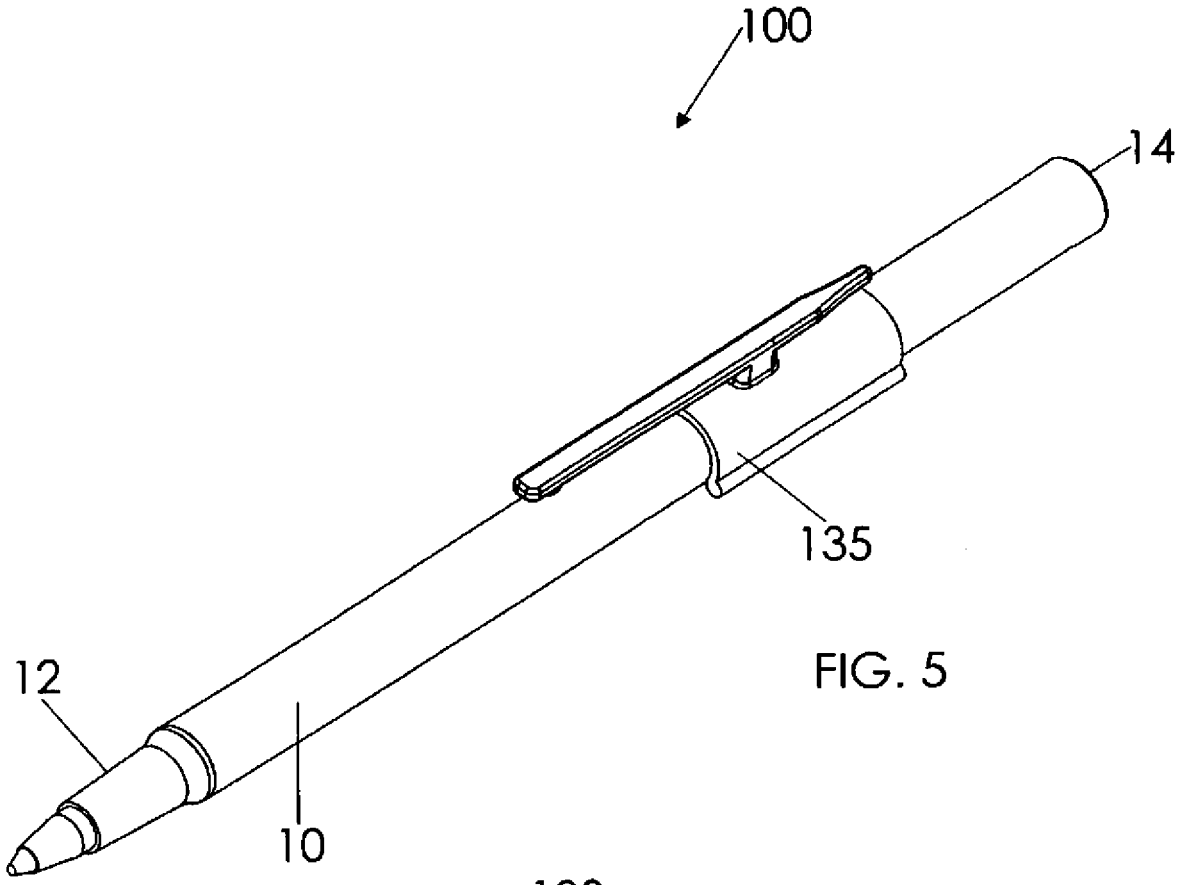
Figure 6:
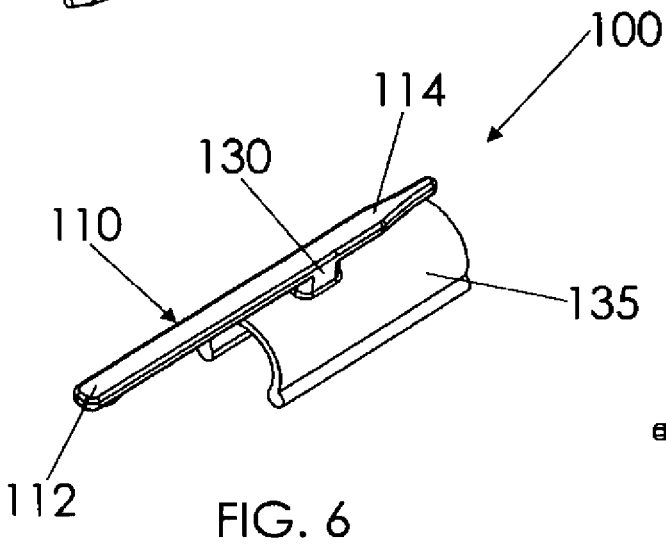
Figure 7:
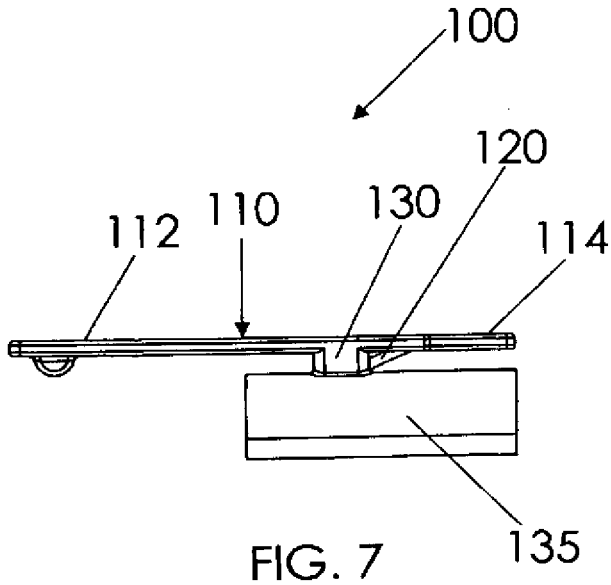
Figure 8:
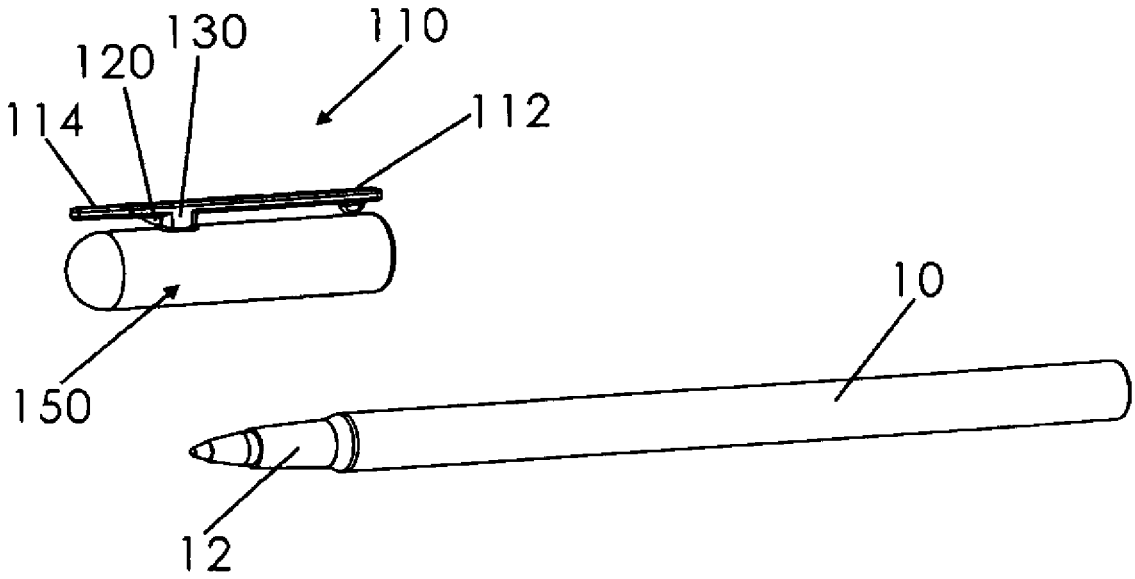
Figure 9:
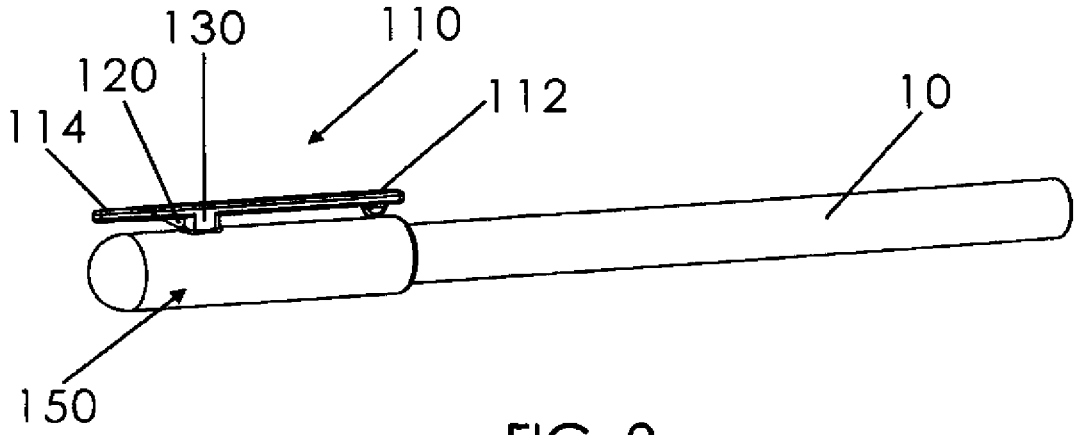

As shown in FIG. 1*a*, a writing instrument 10 (e.g., a pen, pencil, marker, etc.) includes a writing end 12 and a distal end 14. An element 130 operatively connects the elongate clip 110 to the writing instrument 10. The element 130 is also referred to herein as a protrusion 130 extending generally perpendicular from the elongate clip 110. The protrusion 130 may connect the elongate clip 110 permanently to the writing instrument 10, as shown in FIGS. 1*a* through 4*c*, or the protrusion 130 may connect the elongate clip 110 to a sleeve 135 configured for removable attachment to the writing instrument 10, as shown in FIGS. 5 through 7. The sleeve 135 may also be a cap 150 configured to cover the writing end 12 of the writing instrument 10 (FIGS. 8-9).

The cutting blade 120 extends between the elongate clip 110 and the protrusion 130 to open a letter when the letter is passed between the elongate clip 110 and the writing instrument 10 from the distal end 14 toward the writing end 12. In one embodiment, the cutting blade 120 is centered along the elongate clip 110 and the protrusion 130. More particularly, the elongate clip 110 has a width, the protrusion 130 has a width, and the cutting blade 120 is generally centered along the elongate clip width and the protrusion width.

In one embodiment, as shown in FIGS. 1*a*, 1*b*, 5, 6, and 7, the elongate clip 110 has a first portion 112 extending from the protrusion 130 toward the writing end 12 and a second portion 114 extending from the protrusion 130 toward the distal end 14. The cutting blade 120 extends between the elongate clip second portion 114 and the protrusion 130, and the elongate clip 110 is not rotatable relative to the writing instrument 10. The first portion 112 may be longer than the second portion 114, and in one embodiment the first portion 112 is at least twice as long as the second portion 114.

Figure 3:
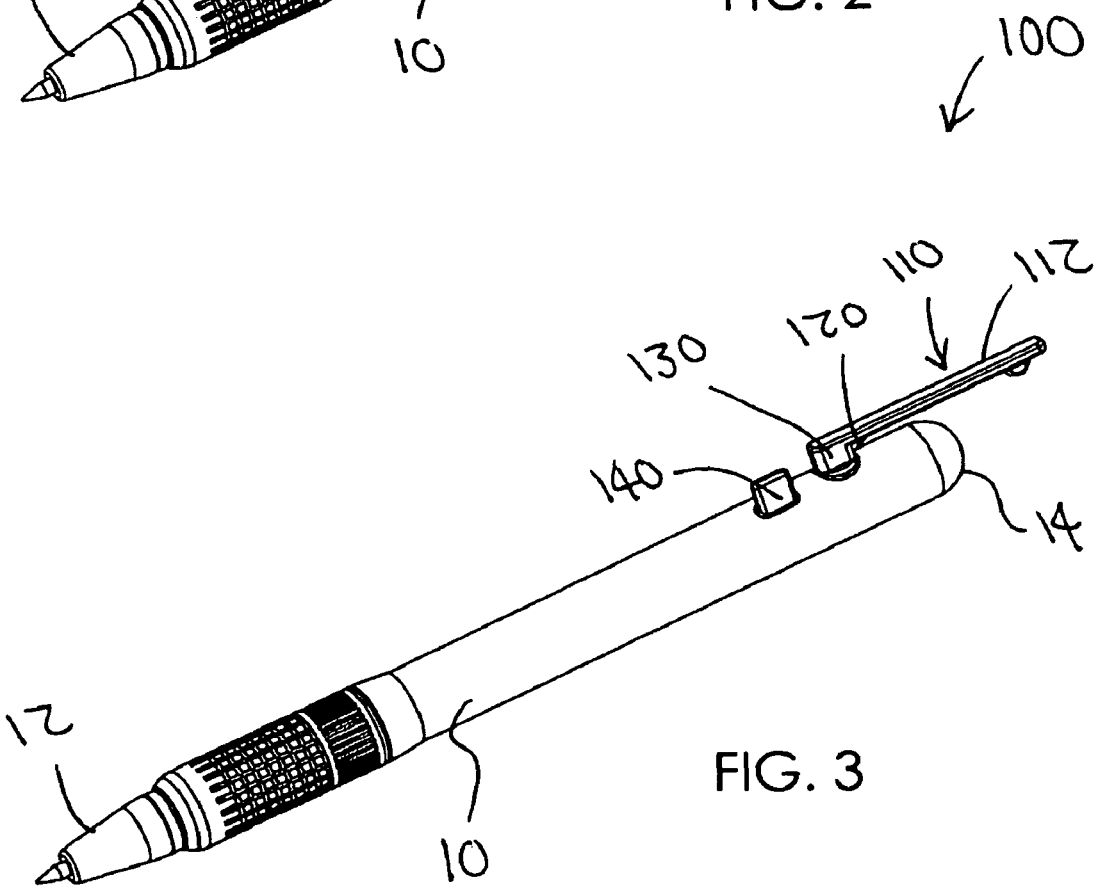
FIG. 3 is another perspective view of the letter opening device as in FIG. 2 with the elongate clip in a second configuration.
Figure 4A:
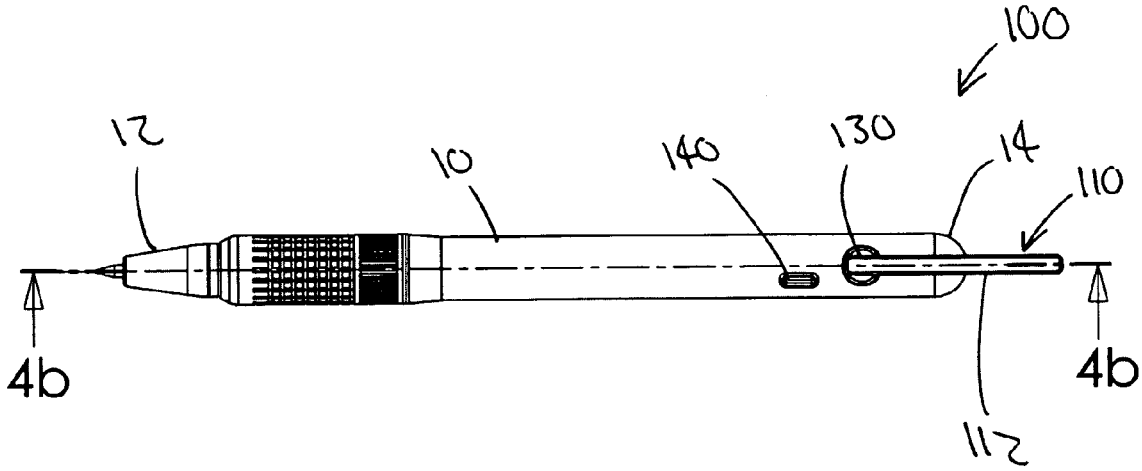
FIG. 4*a* is a top view of the letter opening device as in FIG. 3.
Figure 4B:
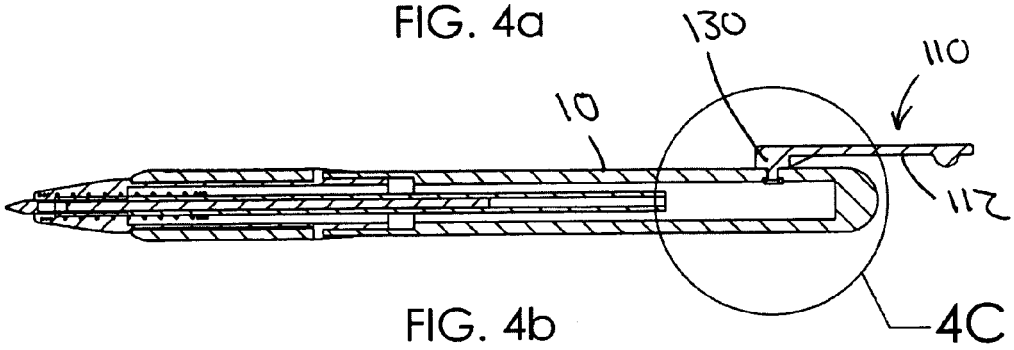
FIG. 4*b* is a sectional view taken along line 4*b*-4*b* of FIG. 4*a;*
Figure 4C:
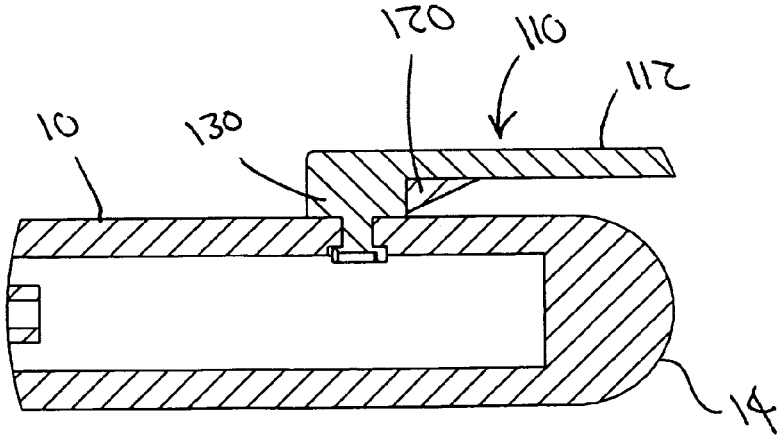
FIG. 4*c* is an isolated view on an enlarged scale taken from a portion of FIG. 4*b;*

In another embodiment, as shown in FIGS. 2 through 4*c*, the elongate clip 110 is rotatable between a first configuration (FIG. 2) and a second configuration (FIG. 3). As in the embodiment discussed above, the first portion 112 extends from the protrusion 130. When at the first configuration (FIG. 2), the elongate clip first portion 112 extends from the protrusion 130 toward the writing end 12. The cutting blade 120 extends between the elongate clip first portion 112 and the protrusion 130. When at the second configuration (FIG. 3), the elongate clip first portion 112 extends toward the distal end 14 to open a letter passing between the elongate clip 110 and the writing instrument 10 from the distal end 14 toward the writing end 12. A stationary post 140 extends adjacent the elongate clip 110 to restrict access to the cutting blade 120 when the elongate clip 110 is at the first configuration.

In use, if the elongate clip 110 is not rotatable relative to the writing instrument 10, a user may pass an envelope between the elongate clip 110 and the writing instrument 10 from the distal end 14 toward the writing end 12 to cut the envelope with the cutting blade 120. If the elongate clip 110 is rotatable relative to the writing instrument 10, the elongate clip 110 may be rotated to the second configuration as discussed above, and a user may then pass an envelope between the elongate clip 110 and the writing instrument 10 from the distal end 14 toward the writing end 12 to cut the envelope with the cutting blade 120. The post 140 may restrict access to the cutting blade 120 when the elongate clip 110 is at the first configuration to avoid inadvertently cutting items. The post 140 may also help maintain the elongate clip 110 at the first configuration. Whether the elongate clip 110 is stationary or rotatable, centering the cutting blade 120 along the elongate clip 110 and the protrusion 130 may make the cutting blade 120 more difficult to inadvertently access through the sides of the elongate clip 110. If the sleeve 135 is included, the sleeve 135 may be removed from the writing instrument 10 and attached to another writing instrument as desired. In addition, if the clip 110 is attached to a cap 150, the cap 150 may be selectively inserted over the writing end 12 of the writing instrument 10 (FIG. 9) or maintained separate from the writing instrument 10 (FIG. 8). Even when separated, the clip 110 may be operated as described above.

It is understood that while certain forms of this invention have been illustrated and described, it is not limited thereto except insofar as such limitations are included in the following claims and allowable functional equivalents thereof.

The invention claimed is:

1. A letter opening device for a writing instrument having a writing end and a distal end, the device comprising:

an elongate clip;

a protrusion extending generally perpendicular from said elongate clip for operative coupling to said writing instrument;

a cutting blade extending between said elongate clip and said protrusion to open a letter when the letter is passed between said elongate clip and said writing instrument from said distal end toward said writing end;

wherein:

said elongate clip is rotatable between first and second configurations and has a first portion extending from said protrusion;

when at said first configuration, said elongate clip first portion extends from said protrusion toward said writing end;

said cutting blade extends between said elongate clip first portion and said protrusion;

when at said second configuration, said elongate clip first portion extends toward said distal end to open a letter passing between said elongate clip and said writing instrument from said distal end toward said writing end; and a stationary post extends adjacent said elongate clip to restrict access to said cutting blade when said elongate clip is at said first configuration.

2. The letter opening device of claim 1, wherein:

said elongate clip has a second portion extending from said protrusion toward said distal end;

said first portion is longer than said second portion.

3. The letter opening device of claim 2, wherein said first portion is at least twice as long as said second portion.

4. The letter opening device of claim 2, wherein said protrusion includes a configuration adapted to be permanently coupled to said writing instrument.

5. The letter opening device of claim 2, wherein said protrusion is coupled to one of a sleeve and a cap for removably coupling said protrusion to said writing instrument.

6. The letter opening device of claim 2, wherein:

said elongate clip has a width;

said protrusion has a width;

said cutting blade is generally centered along said elongate clip width; and said cutting blade is generally centered along said protrusion width.

7. The letter opening device of claim 1, wherein said protrusion is adapted to be permanently coupled to said writing instrument.

8. The letter opening device of claim 1, wherein said protrusion is coupled to one of a sleeve or a cap for being removably coupled to said writing instrument.

9. The letter opening device of claim 1, wherein:

said elongate clip has a width;

said protrusion has a width;

said cutting blade is generally centered along said elongate clip width; and said cutting blade is generally centered along said protrusion width.

10. A letter opening device for a writing instrument having a writing end and a distal end, the device comprising:

an elongate clip;

a protrusion extending from said elongate clip, said protrusion coupling said elongate clip to said writing instrument or a sleeve configured for attachment to said writing instrument; and a cutting blade extending between said elongate clip and said protrusion to open a letter when the letter is passed between said elongate clip and said writing instrument toward said writing end;

wherein:

said elongate clip is rotatable between first and second configurations and has a first portion extending from said protrusion;

when at said first configuration, said elongate clip first portion extends from said protrusion toward said writing end;

said cutting blade extends between said elongate clip first portion and said protrusion;

when at said second configuration, said elongate clip first portion extends toward said distal end to open a letter passing between said elongate clip and said writing instrument from said distal end toward said writing end; and a stationary post extends adjacent said elongate clip to restrict access to said cutting blade when said elongate clip is at said first configuration.

11. The letter opening device of claim 10, wherein:

said elongate clip has a second portion extending from said protrusion toward said distal end;

said first portion is longer than said second portion.

12. The letter opening device of claim 10, wherein:

said elongate clip has a width;

said protrusion has a width;

said cutting blade is generally centered along said elongate clip width; and said cutting blade is generally centered along said protrusion width.

* * * * *

UNITED STATES PATENT AND TRADEMARK OFFICE

CERTIFICATE OF CORRECTION

PATENT NO. : 8,016,505 B2
APPLICATION NO. : 12/102078
DATED : September 13, 2011
INVENTOR(S) : Kole Zekaj It is certified that error appears in the above-identified patent and that said Letters Patent is hereby corrected as shown below:

Delete the title page and substitute therefore the attached title page consisting of corrected illustrative figure.

Delete Drawing Sheets 1-5 and substitute therefore the attached Drawing Sheets 1-5 consisting of the formal figures 1-9.

Signed and Sealed this
Tenth Day of January, 2012

David J. Kappos

David J. Kappos
*Director of the United States Patent and Trademark Office*

(12) United States Patent
Zekaj

(10) Patent No.: US 8,016,505 B2
(45) Date of Patent: Sep. 13, 2011

(54) LETTER OPENER

(76) Inventor: Kole Zekaj, West Bloomfield, MI (US)

( * ) Notice: Subject to any disclaimer, the term of this patent is extended or adjusted under 35 U.S.C. 154(b) by 746 days.

(21) Appl. No.: 12/102,078

(22) Filed: Apr. 14, 2008

(65) Prior Publication Data

US 2009/0257814 A1 Oct. 15, 2009

(51) Int. Cl.
*B43K 29/00* (2006.01)
*B43K 23/02* (2006.01)
*B26B 11/00* (2006.01)

(52) U.S. Cl. ..... 401/195; 401/131; 7/160

(58) Field of Classification Search ..... 401/131, 401/195, 52; 7/160, 158
See application file for complete search history.

(56) References Cited

U.S. PATENT DOCUMENTS

| | | | | |
|---|---|---|---|---|
| 4,081,907 | A | 4/1978 | Bosshold | |
| 6,065,169 | A | 5/2000 | Cheldin | |
| 6,163,910 | A | 12/2000 | Cheldin | |
| D450,086 | S | 11/2001 | Rosenbaum | |
| 6,846,123 | B1 * | 1/2005 | Bedford | 401/195 |
| 7,287,925 | B2 * | 10/2007 | Barker | 401/195 |

* cited by examiner

*Primary Examiner* — David J. Walczak
*Assistant Examiner* — Bradley Oliver
(74) *Attorney, Agent, or Firm* — Dale J. Ream

(57) ABSTRACT

A letter opening device for use with a writing instrument having a writing end and a distal end includes an elongate clip and a protrusion generally perpendicular from the elongate clip for operative coupling to the writing instrument. The letter opening device also includes a cutting blade extending between the elongate clip and the protrusion to open a letter when the letter is passed between the elongate clip and the writing instrument from the distal end toward said writing end. The protrusion may alternatively be coupled to a sleeve for removable attachment to the writing instrument.

12 Claims, 5 Drawing Sheets

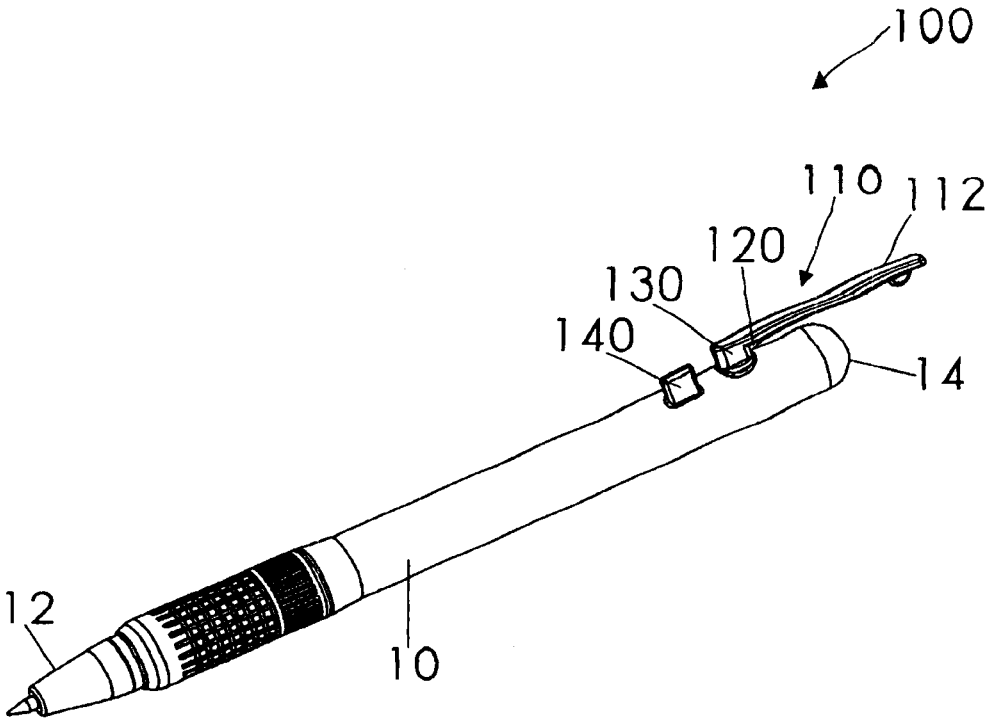

UNITED STATES PATENT AND TRADEMARK OFFICE

CERTIFICATE OF CORRECTION

PATENT NO. : 8,016,505 B2
APPLICATION NO. : 12/102078
DATED : September 13, 2011
INVENTOR(S) : Kole Zekaj It is certified that error appears in the above-identified patent and that said Letters Patent is hereby corrected as shown below:

Delete the title page and substitute therefore the attached title page consisting of corrected illustrative figure.

Delete Drawing Sheets 1-5 and substitute therefore the attached Drawing Sheets 1-5 consisting of the formal figures 1-9.

This certificate supersedes the Certificate of Correction issued January 10, 2012.

Signed and Sealed this
Twenty-first Day of February, 2012

David J. Kappos

David J. Kappos
*Director of the United States Patent and Trademark Office*

(12) United States Patent
Zekaj

(10) Patent No.: US 8,016,505 B2
(45) Date of Patent: Sep. 13, 2011

(54) LETTER OPENER

(76) Inventor: Kole Zekaj, West Bloomfield, MI (US)

( * ) Notice: Subject to any disclaimer, the term of this patent is extended or adjusted under 35 U.S.C. 154(b) by 746 days.

(21) Appl. No.: 12/102,078

(22) Filed: Apr. 14, 2008

(65) Prior Publication Data

US 2009/0257814 A1 Oct. 15, 2009

(51) Int. Cl.
*B43K 29/00* (2006.01)
*B43K 23/02* (2006.01)
*B26B 11/00* (2006.01)

(52) U.S. Cl. ..... 401/195; 401/131; 7/160

(58) Field of Classification Search ..... 401/131, 401/195, 52; 7/160, 158
See application file for complete search history.

(56) References Cited

U.S. PATENT DOCUMENTS

| | | | | |
|---|---|---|---|---|
| 4,081,907 | A | 4/1978 | Bosshold | |
| 6,065,169 | A | 5/2000 | Cheldin | |
| 6,163,910 | A | 12/2000 | Cheldin | |
| D450,086 | S | 11/2001 | Rosenbaum | |
| 6,846,123 | B1 * | 1/2005 | Bedford | 401/195 |
| 7,287,925 | B2 * | 10/2007 | Barker | 401/195 |

* cited by examiner

*Primary Examiner* — David J. Walczak
*Assistant Examiner* — Bradley Oliver
(74) *Attorney, Agent, or Firm* · Dale J. Ream

(57) ABSTRACT

A letter opening device for use with a writing instrument having a writing end and a distal end includes an elongate clip and a protrusion generally perpendicular from the elongate clip for operative coupling to the writing instrument. The letter opening device also includes a cutting blade extending between the elongate clip and the protrusion to open a letter when the letter is passed between the elongate clip and the writing instrument from the distal end toward said writing end. The protrusion may alternatively be coupled to a sleeve for removable attachment to the writing instrument.

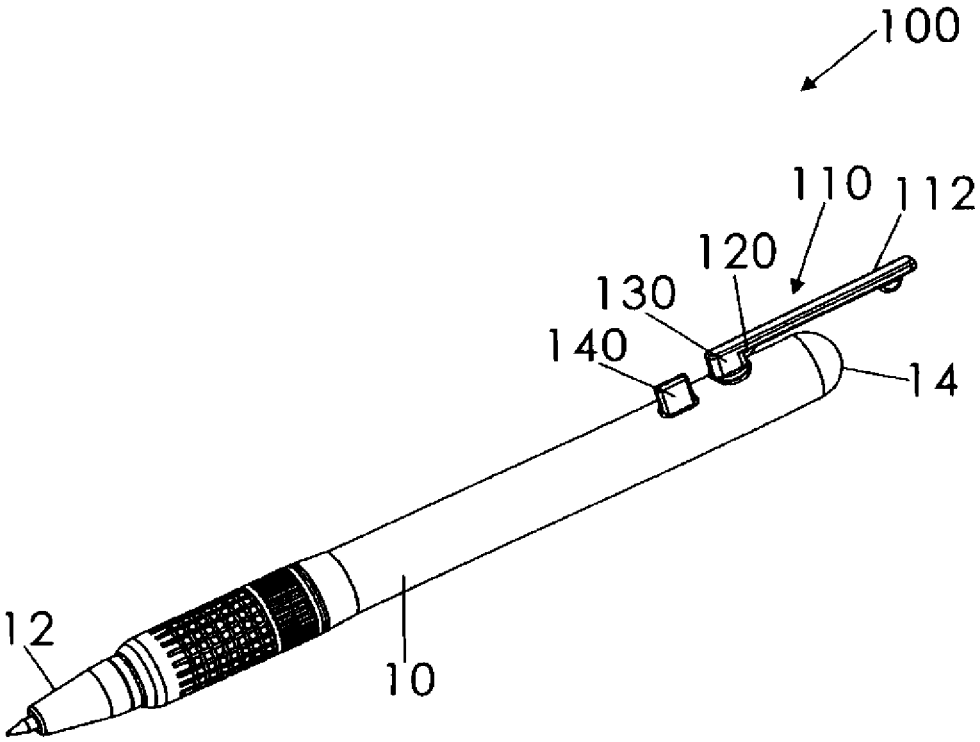

12 Claims, 5 Drawing Sheets